US006615782B1

(12) United States Patent
Hendriksma et al.

(10) Patent No.: US 6,615,782 B1
(45) Date of Patent: Sep. 9, 2003

(54) TWO-STEP FINGER FOLLOWER ROCKER ARM

(75) Inventors: Nick J. Hendriksma, Grand Rapids, MI (US); Wayne S. Harris, Hilton, NY (US); Timothy W. Kunz, Rochester, NY (US); Joseph F. Girtler, Williamson, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/121,720

(22) Filed: Apr. 12, 2002

(51) Int. Cl.[7] ..... F01L 1/18

(52) U.S. Cl. ..... 123/90.39; 123/90.16; 123/90.41; 123/90.44; 123/90.45; 29/888.2; 74/559

(58) Field of Search ..... 123/90.41, 90.39, 123/90.44, 90.45, 90.16; 29/888.2; 74/517, 559

(56) References Cited

U.S. PATENT DOCUMENTS 5,046,462 A * 9/1991 Matayoshi et al. ..... 123/90.16
5,203,289 A * 4/1993 Hara et al. ..... 123/90.16
5,529,033 A * 6/1996 Hampton ..... 123/90.16
5,544,626 A * 8/1996 Diggs et al. ..... 123/90.16
5,655,488 A * 8/1997 Hampton et al. ..... 123/90.16
6,053,135 A * 4/2000 Ochiai et al. ..... 123/90.16
6,314,928 B1 * 11/2001 Baraszu et al. ..... 123/90.16

* cited by examiner

*Primary Examiner*—Thomas Denion
*Assistant Examiner*—Ching Chang
(74) *Attorney, Agent, or Firm*—Patrick M. Griffin

(57) ABSTRACT

A two-step finger follower rocker arm assembly including a follower body having a socket at a first end for engaging a hydraulic lash adjuster and a pad at an opposite end for engaging a valve stem. A passage through the follower body in the direction of actuation by an engine cam lobe is slidingly receivable of a slider member for variably engaging a central cam lobe, preferably a high-lift lobe. An elongate shaft extends through a transverse bore in the slider member and through a slotted passage in the slider member. In the follower body, the shaft is provided with bearings supporting first and second lateral roller followers on opposite sides of the body for variably engaging first and second preferably low-lift lateral cam lobes flanking the central cam lobe. A lost-motion spring urges the slider member into contact with the central lobe. A latch member driven by a piston selectively locks the slider member to the follower body such that the follower follows the motion of the central cam lobe. When the latch member is disengaged from the slider member, the member slides within the follower body, allowing the lateral rollers to engage and follow the lateral cam lobes. Preferably, the latching mechanism is provided as a pre-assembled cartridge unit.

18 Claims, 7 Drawing Sheets

TWO-STEP FINGER FOLLOWER ROCKER ARM

TECHNICAL FIELD

The present invention relates to mechanisms for altering the actuation of valves in internal combustion engines; more particularly, to finger follower type rocker arms having means for changing between high and low or no valve lifts; and most particularly, to a two-step finger follower type rocker arm having a slider member disposed in a finger follower body for sliding motion in the direction of lift between high and low positions and having a locking pin operative in an orthogonal bore in the finger follower body for latching and unlatching the slider member and the finger follower body to shift between high lift and low lift modes.

BACKGROUND OF THE INVENTION

Variable valve activation (VVA) mechanisms for internal combustion engines are well known. It is known to be desirable to lower the lift, or even to provide no lift at all, of one or more valves of a multiple-cylinder engine, especially intake valves, during periods of light engine load. Such deactivation can substantially improve fuel efficiency.

Various approaches have been disclosed for changing the lift of valves in a running engine. One known approach is to provide an intermediary cam follower arrangement which is rotatable about the engine camshaft and is capable of changing both the valve lift and timing, the cam shaft typically having both high-lift and low-lift lobes for each such valve. Such an arrangement can be complicated and costly to manufacture and difficult to install onto a camshaft during engine assembly.

Another known approach is to provide a deactivation mechanism in the hydraulic lash adjuster (HLA) upon which a cam follower rocker arm pivots. Such an arrangement is advantageous in that it can provide variable lift from a single cam lobe by making the HLA either competent or incompetent to transfer the motion of the cam eccentric to the valve stem. A shortcoming of providing deactivation at the HLA end of a rocker arm is that, because the cam lobe actuates the rocker near its longitudinal center point, the variation in lift produced at the valve-actuating end can be only about one-half of the extent of travel of the HLA deactivation mechanism.

Still another known approach is to provide a deactivation mechanism in the valve-actuating end of a rocker arm cam follower (opposite from the HLA pivot end) which locks and unlocks the valve actuator portion from the follower body. Unlike the HLA deactivation approach, this approach typically requires both high-lift and low-lift cam lobes to provide variable lift.

It is a principal object of the present invention to provide a simplified variable valve lift apparatus.

It is a further object of the invention to provide an increased range of motion between a high lift and a low lift position of an engine valve.

SUMMARY OF THE INVENTION

Briefly described, a two-step finger follower rocker arm assembly in accordance with the invention includes an elongate, rigid follower body having a socket at a first end for engaging a conventional hydraulic lash adjuster as a pivot means, and having an arcuate pad at a second and opposite end for engaging a valve stem or lifter means. A passage through the follower body in the direction of actuation by an engine cam lobe is slidingly receivable of a slider member for variably engaging a central cam lobe, preferably a high-lift lobe. A transverse bore in the follower body intersects the passage. A slotted passage is provided in the slider member, and an elongate pin extends through the bore in the body and through the slotted passage in the slider member such that the length of travel of the slider member in the passage is at least the length of the slotted passage therein. Outboard of the follower body, the pin is provided on either side of the body with first and second identical lateral roller followers, preferably rotatably mounted in bearings on the pin, for variably engaging first and second lateral cam lobes, preferably low-lift lobes, flanking the central cam lobe. A lost-motion spring urges the slider member into contact with the central lobe, and the hydraulic lash adjuster urges the lateral rollers into contact with the lateral lobes when the slider member is unlatched. A transverse locking pin can selectively engage and lock the slider member to the follower body such that the follower follows the motion of the central cam lobe. When the locking pin is disengaged from the slider member, the member slides within the follower body, allowing the lateral rollers to engage and follow the lateral lobes. Means are provided for limiting the rotational movement of the slider member in the body passage. Preferably, the central lobe is a high-lift lobe and the lateral lobes are low-lift lobes. Preferably, the locking pin is provided as a pre-assembled cartridge unit.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
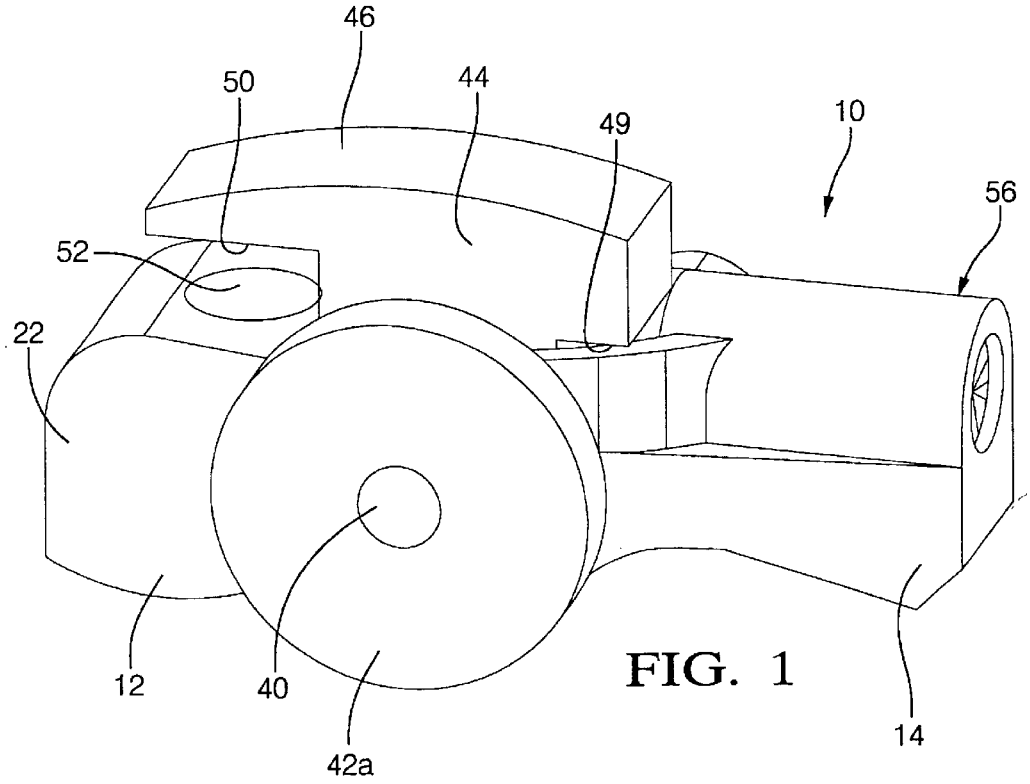
FIG. 1 is an isometric view from the front of a two-step finger follower rocker arm assembly in accordance with the invention.
Figure 3:
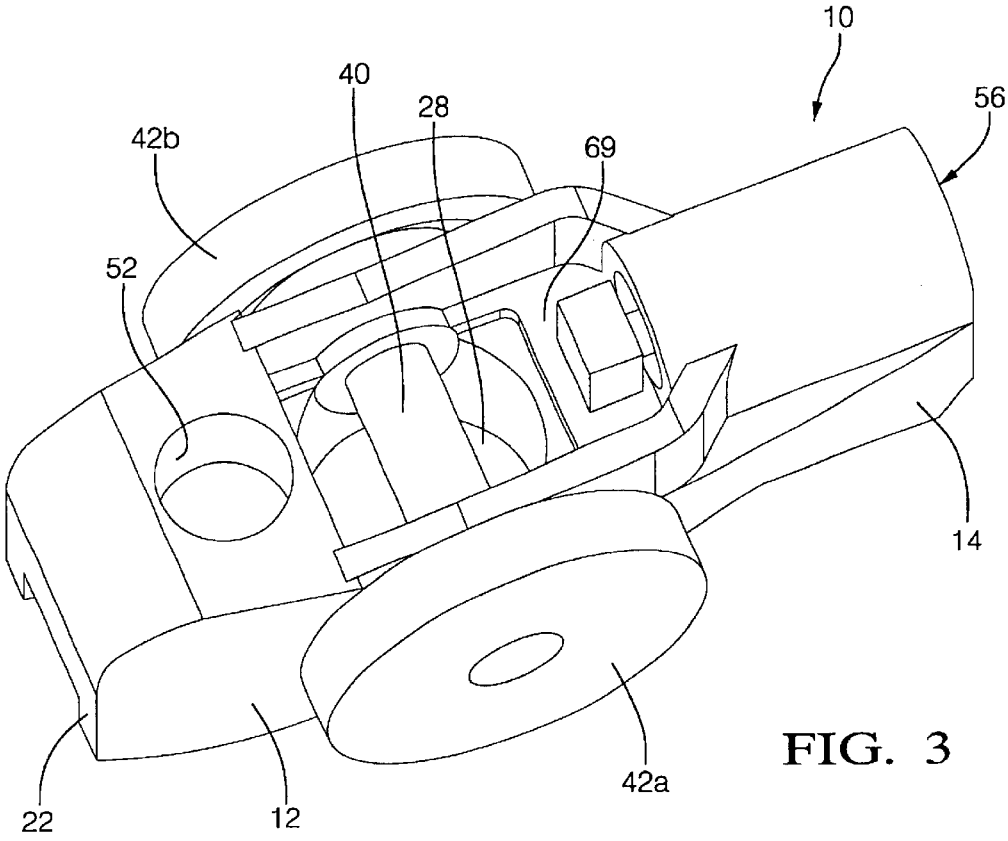
FIG. 3 is an isometric view from above of the rocker arm assembly shown in FIG. 1, the slider member being omitted for illustration.
Figure 2:
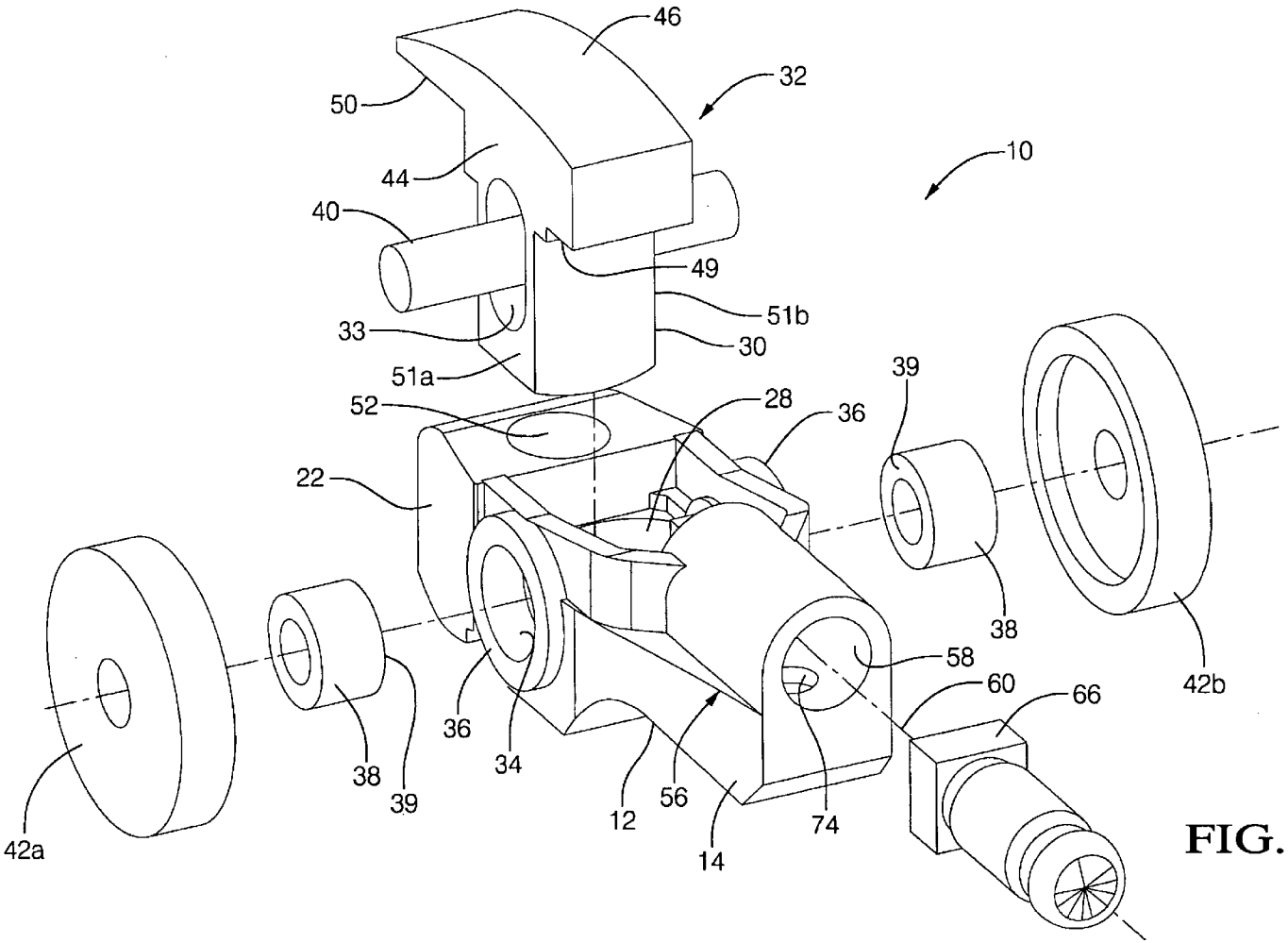
FIG. 2 is an exploded isometric view of the rocker arm assembly shown in FIG. 1.
Figure 6:
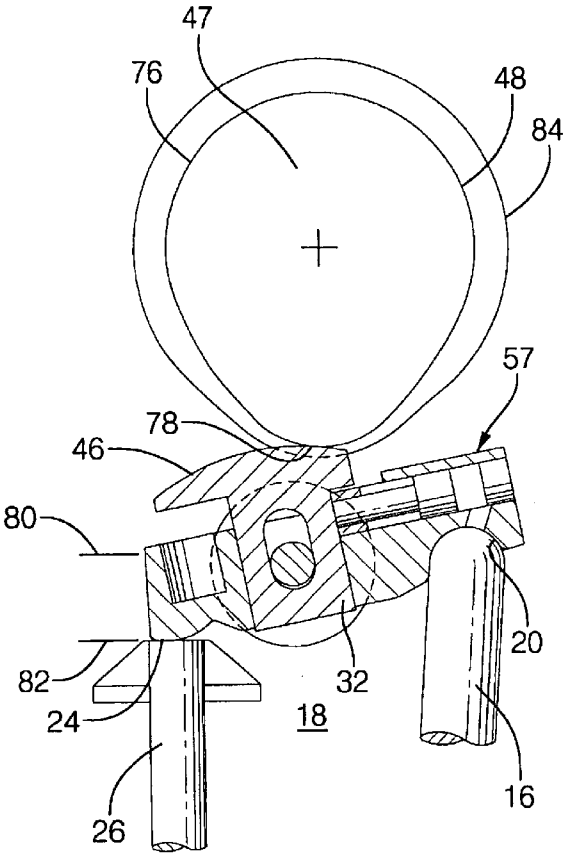
FIG. 6 is an elevational cross-sectional view like that shown in FIG. 4, showing the locking pin in locked position in the slider member, the nose of the central cam lobe on the slider member, and the valve opened to a high-lift position.
Figure 5:
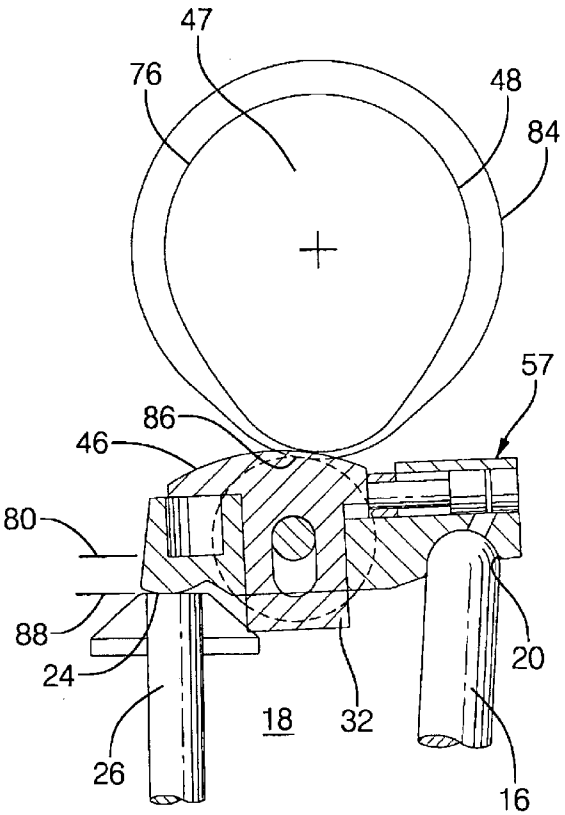
FIG. 5 is an elevational cross-sectional view like that shown in FIG. 4, showing the locking pin still unlocked, the lateral roller followers on the nose of the lateral cam lobes, and the valve opened to a low-lift position.
Figure 4:
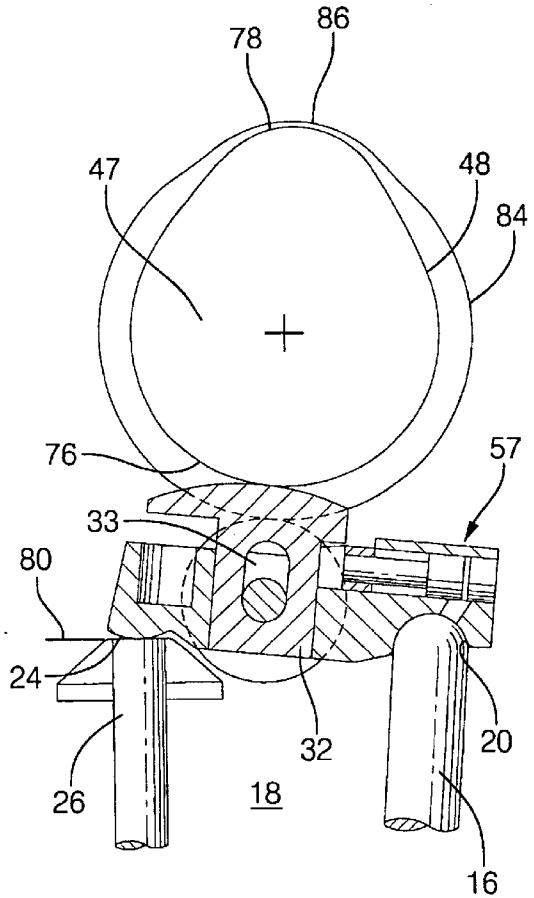
FIG. 4 is an elevational cross-sectional view of the rocker arm assembly shown in FIG. 1, installed schematically in an internal combustion engine and having the associated valve closed, the locking pin unlocked, and the slider member on the base circle portion of the central cam lobe.

Referring to FIGS. 1 through 6, a two-step finger follower rocker arm assembly 10 in accordance with the invention includes a follower body 12 having a first end 14 having means for receiving the head of a hydraulic lash adjuster 16 for pivotably mounting assembly 10 in an engine 18. The receiving means is preferably a spherical socket 20, as shown in FIGS. 4–6. A second and opposite end 22 of follower body 12 is provided with a pad 24, preferably arcuate, for interfacing with and actuating a valve stem 26. Body 12 is provided with a passage 28 therethrough between socket 20 and pad 24, passage 28 being generally cylindrical for slidably receiving a partially-cylindrical mating portion 30 of a slider member 32 having a longitudinal slot 33 therein. Body 12 is further provided with a first bore 34 transverse of passage 28, ending in bosses 36 for receiving roller bearings 38 for rotatably supporting a shaft 40 extending through bore 34 and slot 33 to slidably retain slider member 32 in passage 28. Each roller bearing 38 includes an inner face 39. First and second lateral follower rollers 42*a,b* are mounted on opposite ends, respectively, of shaft 40.

Figure 10:
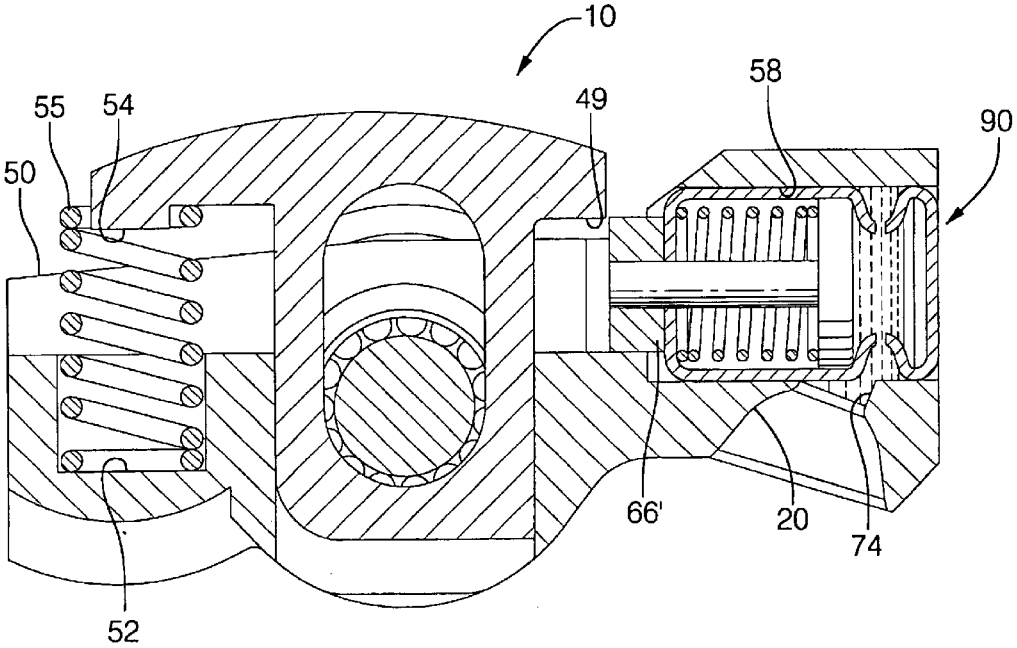
FIG. 10 is an elevational cross-sectional view of a two-step finger follower in accordance with the invention, including the cartridge pin subasssembly shown in FIG. 8, the pin and slider member being in the unlocked position.
Figure 11:
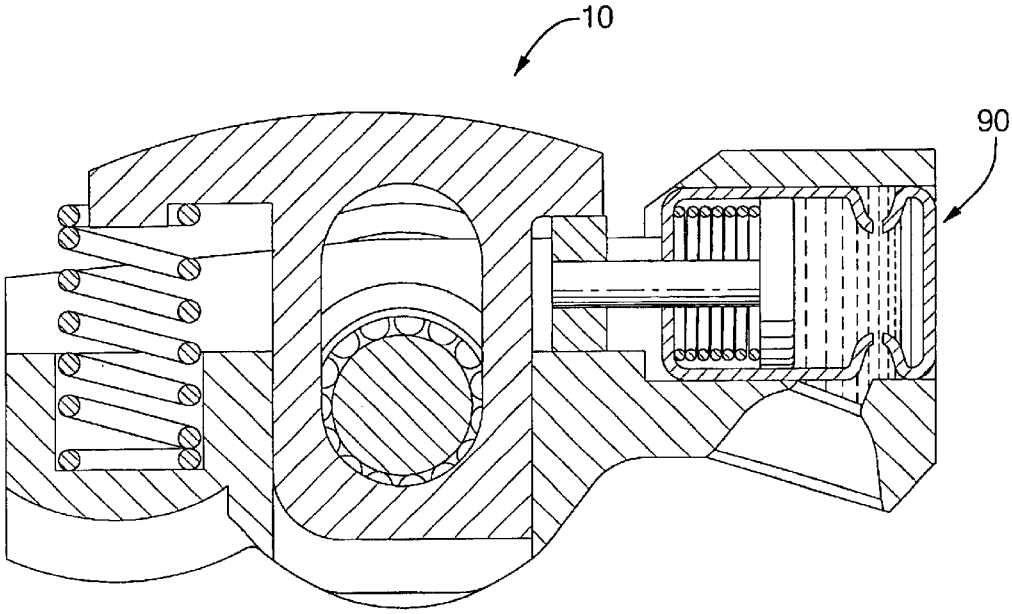
FIG. 11 is an elevational cross-sectional view like that shown in FIG. 10, showing the pin and slider member in the locked position

Slider member 32 further includes an actuating portion 44 having an arcuate outer surface 46 for engaging a central cam lobe 48 of an engine camshaft 47. Portion 44 extends toward first and second ends 14,22 of body 12 to define, respectively, a latching surface 49 and a spring seat 50. Portion 44 extends away from outer surface 46 to define flats 51*a, b* in cylindrical mating portion 30. When slider member 32 is received in passage 28 of body 12, each inner face 39 of roller bearings 38 is located in close proximity of flats 51*a, b* thereby limiting the rotational movement of slider member 32 in passage 28. Second end 22 of body 12 is provided with a well 52 for receiving a lost-motion spring 54 disposed between end 22 and spring seat 50 (spring 54 shown in FIG. 10 but omitted from the other drawings for clarity). Spring 54 is received at its other end by pin 55 defined by spring seat 50. Thus, pin 55, guided close fittedly by the inside diameter of spring 54, in conjunction with the close proximity of roller bearing inner faces 39 to slider member flats 51*a, b*, serve to limit undesirable rotation of slider member 32.

First end 14 is further provided with a latching mechanism 56 for engaging and locking slider member 32 at its most outward extreme of motion in passage 28. Mechanism 56 comprises a stepped second bore 58 in body 12 and having an axis 60 intersecting passage 28, preferably orthogonally, bore 58 being preferably cylindrical.

Referring to FIGS. 4 through 7, a first embodiment 57 of latching means in mechanism 56 includes a piston 62 biased outwards in bore 58 by a return spring 64 and extending toward slider member 32 to support a latch member 66 which may slide along a slide surface 68 in body 12. Bore 58 is closed by a plug 70, forming a hydraulic chamber 72 in communication via passage 74 with socket 20. Pressurized oil may be supplied to chamber 72 in known fashion from HLA 16, upon command from an engine control module (not shown), to cause piston 62 to become hydraulically biased toward slider member 32. When such biasing occurs, to overcome the counter-bias of return spring 64, outer surface 46 being engaged on the base circle portion 76 of central cam lobe 48, latch member 66 is urged axially into latching and locking engagement with latching surface 49. As shown in FIG. 6, when cam lobe 48 rotates to engage nose portion 78 with outer surface 46, valve stem 26 is actuated from a zero lift position 80 to a high lift position 82.

Still referring to FIGS. 4 through 6, central cam lobe 48 is flanked by first and second identical lateral cam lobes 84 (only one visible in FIGS. 4–6) for selectively engaging first and second lateral follower rollers 42*a,b*, respectively. When the engine control module determines, in known fashion from various engine operating parameters, that a low-lift condition is desired, oil pressure is no longer supplied to chamber 72, allowing return spring 64 to again bias piston 62 and associated latch member 66 away from slider member 32. When cam lobe 48 rotates to place surface 46 on base circle portion 76 again, piston 62 unlatches latch member 66 and slider member 32 is again free to slide in passage 28. When the camshaft again rotates to place nose 78 on surface 46, member 32 is depressed into body 12, allowing noses 86 on lateral cam lobes 84 to be engaged by rollers 42*a,b*, as shown in FIG. 5, thus displacing valve stem 26 from zero lift position 80 to a low-lift position 88. As long as oil pressure is withheld from chamber 72, latching mechanism 56 remains disengaged from slider member 32, and assembly 10 functions as a low-lift rocker.

Figure 7:
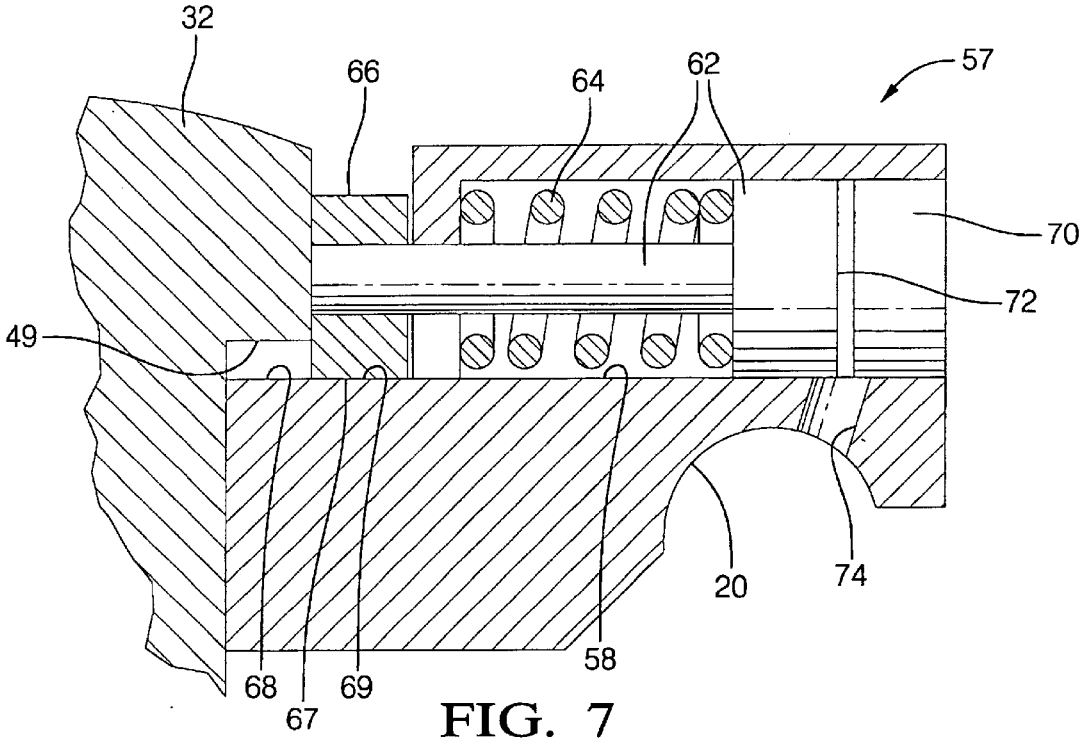
FIG. 7 is an elevational cross-sectional view of a first embodiment of a locking pin assembly in accordance with the invention.
Figure 12A:
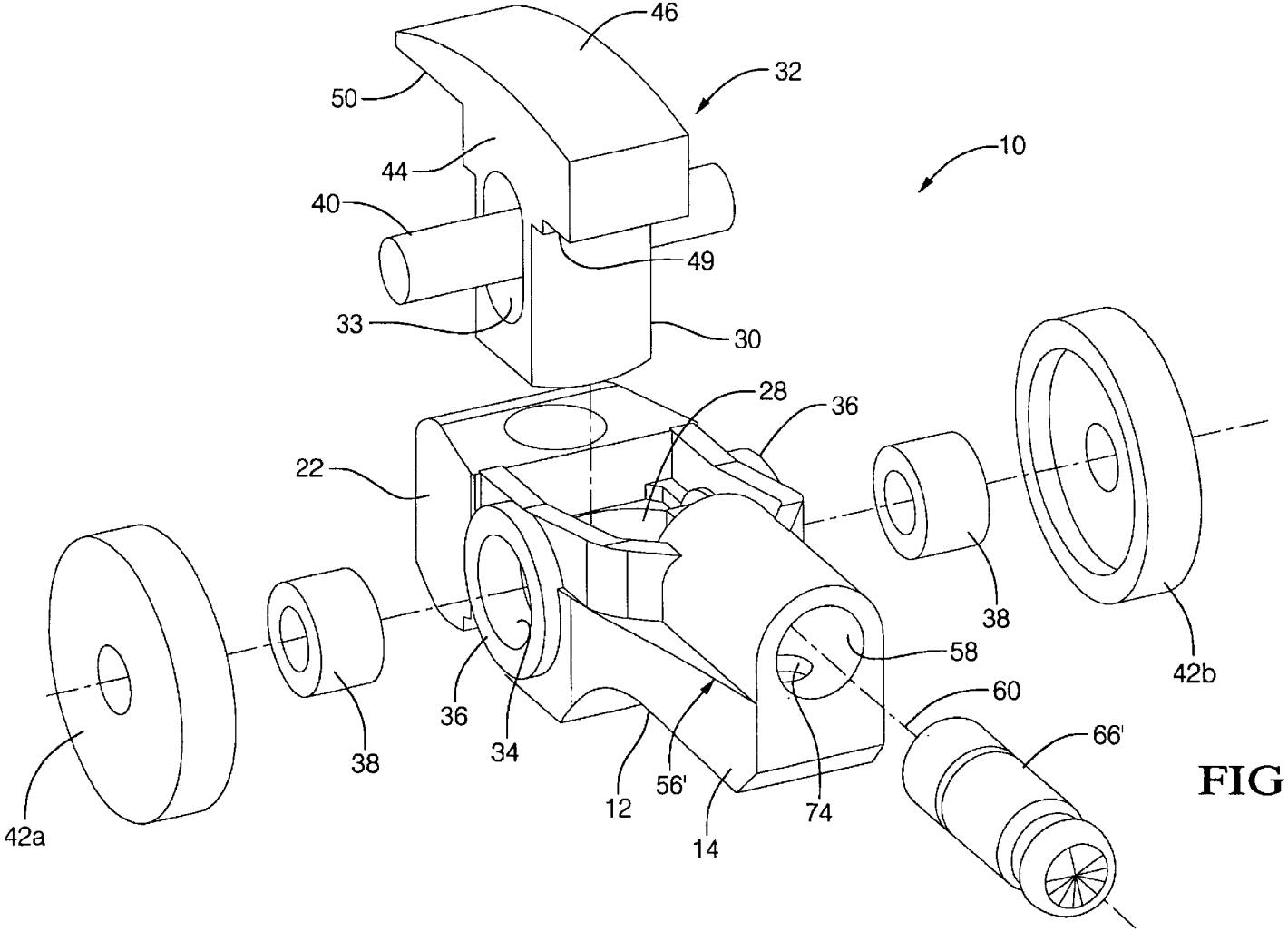
FIG. 12*a* is an exploded isometric view of the rocker arm assembly similar to that shown in FIG. 2 but with the alternate cylindrical shaped latch member.
Figure 12B:
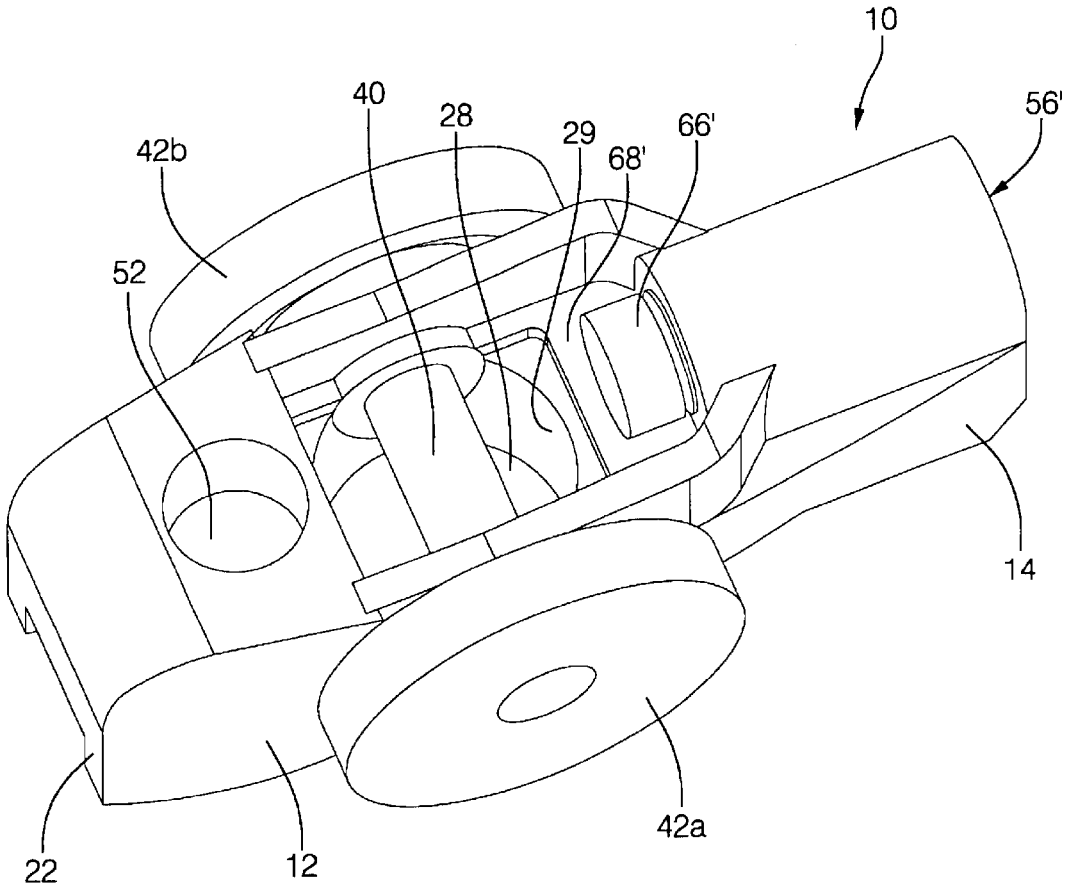
FIG. 12*b* is an isometric view from above of the rocker arm assembly showing the related features of the cylindrical shaped latch member of FIG. 12*a*.

As shown in FIGS. 3 and 7, latch member 66 includes flatted bottom surface 67 for slidable engagement with flatted portion 69 of slider surface 68. Thus, when latch member 66 is in position to lock slider member 32, the downward force exerted on the slider member is supported vertically by latch member 66 and slider surface 68 and is not translated torsionally through piston 62. As an alternate design (FIGS. 12*a* and 12*b*), latch member 66' of latching means in mechanism 56' is cylindrical, cross-sectionally, and latch surface 49' and slider surface 68' are arcuate in shape to match the curvature of latch member 66'.

Of course, it will be seen by those of skill in the art that the dimensions of the lateral cam lobes and lateral follower rollers may be configured to provide any desired degree of lift to valve stem 26 in a range between positions 80 and 88.

Referring to FIGS. 8 through 11, a second embodiment 90 is shown for a latching mechanism 56 in accordance with the invention. Embodiment 90 comprises a latching cartridge 92 which may be inserted into bore 58 and which is preferably and conveniently pre-assembled as a subassembly, thereby greatly simplifying the overall assembly of follower 10. Cartridge 92 includes a body 94, preferably tubular and closed at outer end 96 and sized to be press-fitted into bore 58, thereby eliminating the need for plug 70. Preferably, body 94 is constricted 98 to separate piston 62' from end 96, thereby providing a hydraulic chamber 72' within the cartridge. Constriction 98 is perforated 100 to allow hydraulic communication with passage 74 and socket 20. Body 94 is partially closed at inner end 102 to retain return spring 64' and provide guidance for piston 62' in driving latch member 66' into (FIG. 11) and out of (FIG. 10) engagement with latching surface 49.

Figure 8:
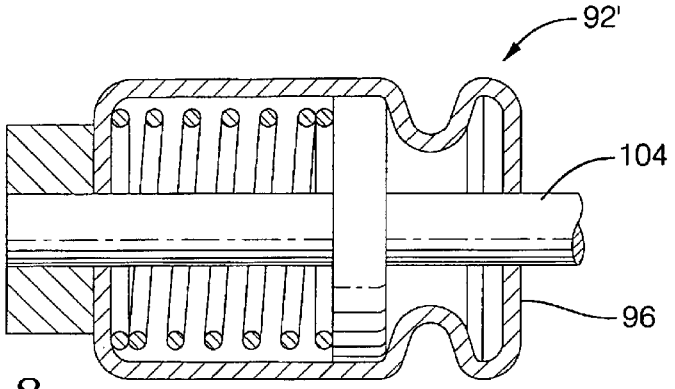
FIG. 8 is an elevational cross-sectional view of a second embodiment of a locking pin assembly, showing a cartridge pin subassembly having a piston extension for mechanical actuation of the locking pin.
Figure 9:
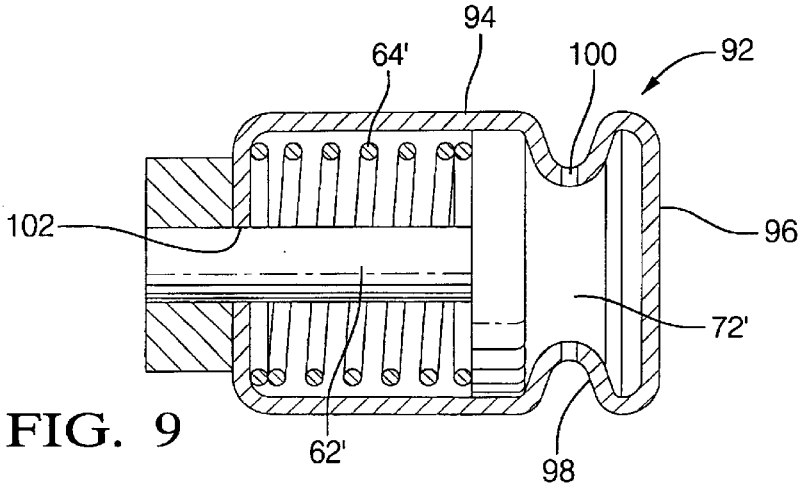
FIG. 9 is a view like that shown in FIG. 8, showing a cartridge pin subassembly without the piston extension, as would be configured for hydraulic actuation of the locking pin.

Referring to FIG. 8, a variation 92' of cartridge 92 is provided with a piston extension 104 slidably extending through outer end 96 for engagement by mechanical or electromechanical actuation means (not shown), for example, a conventional solenoid actuator, in place of the previously-discussed hydraulic actuation.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A two-step finger follower rocker arm assembly for variably activating a gas valve in an internal combustion engine having a camshaft having a central lobe and at least one lateral lobe, comprising:

a) a follower body having means for engaging said engine at a first end of said body and having an interface means for engaging a valve stem at a second end of said body and having a passage formed in said body between said first end and said second end and having a first bore transverse to said passage;

b) a slider member slidably disposed in said passage and having a slot formed therethrough, said member having an outer surface for engaging said central lobe of said camshaft, and having a latching surface;

c) a shaft disposed in said first bore and extending through said slot in said slider member;

d) at least one lateral follower roller disposed on an end of said shaft outside said follower body for engaging said at least one lateral lobe of said camshaft; and e) latching means disposed in said follower body for latching said slider member to said body to engage said outer surface with said central lobe to provide a first rocker assembly mode having a first valve lift capability, and for unlatching said slider member from said body to engage said at least one lateral follower roller with said at least one lateral camshaft lobe to provide a second rocker assembly mode having a second valve lift capability.

2. A rocker arm assembly in accordance with claim 1 wherein said passage extends through said body.

3. A rocker arm assembly in accordance with claim 1 wherein said means for engaging said engine is a spherical socket for receiving a hydraulic lash adjuster.

4. A rocker arm assembly in accordance with claim 1 wherein said interface means for engaging said valve stem is an arcuate pad.

5. A rocker arm assembly in accordance with claim 1 further comprising at least one bearing disposed in said first bore for rotatably supporting said shaft.

6. A rocker arm assembly in accordance with claim 1 further comprising two lateral follower rollers disposed on opposite ends of said shaft.

7. A rocker arm assembly in accordance with claim 1 further comprising lost motion spring means disposed between said follower body and said slider member.

8. A rocker arm assembly in accordance with claim 7 wherein said spring means is a compression spring.

9. A rocker arm assembly in accordance with claim 8 wherein said slider member includes a pin for receiving an end of said compression spring.

10. A rocker arm assembly in accordance with claim 1 wherein said latching means comprises:

a) a second bore formed in said follower body;

b) a piston disposed in said follower body;

c) a latch member attached to said piston for engaging said latching surface in said slider member to latch said slider member to said follower body;

d) a return spring disposed in said second bore for biasing said piston away from said slider member;

e) means for closing said bore to create a hydraulic chamber adjacent said piston; and f) means for selectively providing pressurized oil to said chamber to bias said piston toward said slider member.

11. A rocker arm assembly in accordance with claim 1 wherein said latching means comprises:

a) a second bore formed in said follower body;

b) a piston disposed in said follower body;

c) a latch member attached to said piston for engaging said latching surface in said slider member to latch said slider member to said follower body;

d) a return spring disposed in said second bore for biasing said piston away from said slider member; and e) means for biasing said piston toward said slider member.

12. A rocker arm assembly in accordance with claim 1 wherein said first rocker assembly mode is a high lift mode and said second rocker assembly mode is a low lift mode.

13. A rocker arm assembly in accordance with claim 1 wherein said second rocker assembly mode is a zero lift mode.

14. A rocker arm assembly in accordance with claim 1 further including shaft bearings disposed in said first bore, said slider member having flats extending away from said outer surface and each of said shaft bearings having an inner face whereby each inner face is in close proximity with said flats to limit rotational motion of said slider member.

15. A rocker arm assembly in accordance with claim 10 wherein said latch member includes a flatted surface for slidable engagement with a flatted portion of said latching surface.

16. A rocker arm assembly in accordance with claim 10 wherein said latch member includes a cylindrical surface for slidable engagement with an arcuate portion of said latching surface.

17. A rocker arm in accordance with claim 1 wherein said slider member includes a generally cylindrical portion for mating engagement with said passage of said body.

18. A multiple-cylinder internal combustion engine having a camshaft having a central lobe and at least one lateral lobe, the engine comprising:

a two-step finger follower rocker arm assembly for variably activating a gas valve, including a follower body having means for engaging said engine at a first end of said body and having an interface means for engaging a valve stem at a second end of said body and having a passage formed in said body between said first end and said second end and having a first bore transverse to said passage, a slider member slidably disposed in said passage and having a slot formed therethrough, said member having an outer surface for engaging said central lobe of said camshaft, and having a latching surface, a shaft disposed in said first bore and extending through said slot in said slider member, at least one lateral follower roller disposed on an end of said shaft outside said follower body for engaging said at least one lateral lobe of said camshaft, and latching means disposed in said follower body for latching said slider member to said body to engage said outer surface with said central lobe to provide a first rocker assembly mode having a first valve lift capability, and for unlatching said slider member from said body to engage said at least one lateral follower roller with said at least one lateral camshaft lobe to provide a second rocker assembly mode having a second valve lift capability.

* * * * *